US005219688A

United States Patent [19]

Kashizaki et al.

[11] Patent Number: 5,219,688

[45] Date of Patent: Jun. 15, 1993

[54] ELECTROPHOTOGRAPHIC PHOTOSENSITIVE MEMBER AND ELECTROPHOTOGRAPHIC APPARATUS AND FACSIMILE MACHINE WHICH USE THE ELECTROPHOTOGRAPHIC PHOTOSENSITIVE MEMBER

[75] Inventors: Yoshio Kashizaki; Koichi Suzuki, both of Kanagawa, Japan

[73] Assignee: Canon Kabushiki Kaisha, Tokyo, Japan

[21] Appl. No.: 773,424

[22] Filed: Oct. 9, 1991

[30] Foreign Application Priority Data

Oct. 9, 1990 [JP] Japan ..... 2-269536

[51] Int. Cl.[5] ..... G03G 15/02; G03G 5/00; G03G 15/06

[52] U.S. Cl. ..... 430/57; 430/72; 430/75

[58] Field of Search ..... 430/57, 71, 72, 75

[56] References Cited

U.S. PATENT DOCUMENTS 4,440,845 4/1984 Hashimoto et al. ..... 430/57
4,868,080 9/1989 Umehara et al. ..... 430/73
4,873,164 10/1989 Ono et al. ..... 430/58

FOREIGN PATENT DOCUMENTS 322823 7/1989 European Pat. Off. .
57-138646 8/1982 Japan .
57-202349 12/1982 Japan .
63-233754 9/1988 Japan .
63-282743 11/1988 Japan .
63-003853 7/1989 Japan .
1-312550 12/1989 Japan .

*Primary Examiner*—Marion E. McCamish
*Assistant Examiner*—Stephen Crossan
*Attorney, Agent, or Firm*—Fitzpatrick, Cella, Harper & Scinto

[57] ABSTRACT

An electrophotographic photosensitive member has a conductive substrate and a photosensitive layer formed thereon. The photosensitive layer contains a compound represented by the following formula (1):

(1)

wherein $R_1$ and $R_2$ are the same or different and are each a hydrogen atom, a halogen atom, substituted or unsubstituted alkyl group, and substituted or unsubstituted aryl group, m and n are each of 0. 1 or 2, and $A_1$ and $A_2$ are the same or different and are each a coupler residue having a phenolic hydroxyl group.

12 Claims, 1 Drawing Sheet

ELECTROPHOTOGRAPHIC PHOTOSENSITIVE MEMBER AND ELECTROPHOTOGRAPHIC APPARATUS AND FACSIMILE MACHINE WHICH USE THE ELECTROPHOTOGRAPHIC PHOTOSENSITIVE MEMBER

BACKGROUND OF THE INVENTION

1. Field of the Invention

The present invention relates to an electrophotographic photosensitive member and also to an electrophotographic apparatus and a facsimile machine using the electrophotographic photosensitive member. More particularly, the present invention is concerned with an electrophotographic photosensitive member having a photosensitive layer formed of a material containing a disazo dye having a specific structure, as well as an electrophotographic apparatus and a facsimile machine using such electrophotographic photosensitive member.

2. Description of the Related Arts

Hitherto, various types of organic photoconductive materials for use in electrophotographic photosensitive members have been known, such as photoconductive polymers represented by poly-N-vinylcarbazole, low-molecular organic photoconductive materials represented by 2,5-bis(p-diethylaminophenyl)- 1,3,4-osadiazole, and mixtures of such organic photoconductive materials and various dyes or pigments.

In general, an electrophotographic photosensitive member using an organic photoconductive material offers advantages such as very high yield and comparatively low cost of production, as well as ease of control of color sensitivity through selection of a dye or pigment used therein. Therefore, various studies have been made on this type of electrophotographic photosensitive member. In particular, a new type of photosensitive member, generally referred to as "function-separation type photosensitive member", has been successfully developed lately. This type of photosensitive member has a laminate photoconductive layer composed of a charge generating layer containing an organic photoconductive dye or pigment and a charge transporting layer containing the aforementioned photoconductive polymer or low-molecular organic photoconductive material. It has been confirmed that this type of photosensitive member offers remarkable improvements over known organic electrophotographic photosensitive members which were still unsatisfactory in sensitivity and durability.

Among various known organic photosensitive materials, azo pigments are notable because of superiority in photoconductivity. In addition, various compounds having various characteristics can easily be prepared by using various combinations of the azo component and the coupler component. For example, compounds are proposed and disclosed in Japanese Patent Unexamined Patent Publication Nos. 57-138646, 57-202349 and 63-282743.

The current trends for higher image quality and higher durability of electrophotographic apparatuses have given a rise to the demand for an electrophotographic photosensitive member which has still higher sensitivity and greater stability of electrophotographic characteristics against repeated use.

SUMMARY OF THE INVENTION

Accordingly, an object of the present invention is to provide an electrophotographic photosensitive member having a photosensitive layer made of a material which contains a unique and novel organic photoconductive material.

Another object of the present invention is to provide an electrophotographic photosensitive member having a higher sensitivity than known electrophotographic photosensitive members.

Still another object of the present invention is to provide an electrophotographic photosensitive member which stably exhibits superior electrical potential characteristics even after repeated use.

A further object of the present invention is to provide an electrophotographic apparatus and a facsimile machine each of which incorporates an electrophotographic photosensitive member of the type mentioned above.

To this end, according to one aspect of the present invention, there is provided an electrophotographic photosensitive member, comprising a conductive substrate and a photosensitive layer formed thereon, the photosensitive layer containing a compound represented by the following formula (1):

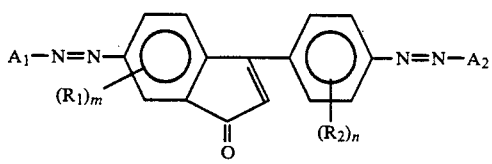

(1)

wherein $R_1$ and $R_2$ are the same or different and are each selected from the group consisting of: a hydrogen atom, a halogen atom, substituted or unsubstituted alkyl group, and substituted or unsubstituted aryl group, m and n respectively are each 0.1 or 2, $A_1$ and $A_2$ are the same or different and are each a coupler residue having a phenolic hydroxyl group.

The invention also provides an electrophotographic apparatus and a facsimile machine each of which incorporates the above-mentioned photosensitive member.

DESCRIPTION OF THE PREFERRED EMBODIMENTS

Figure 1:
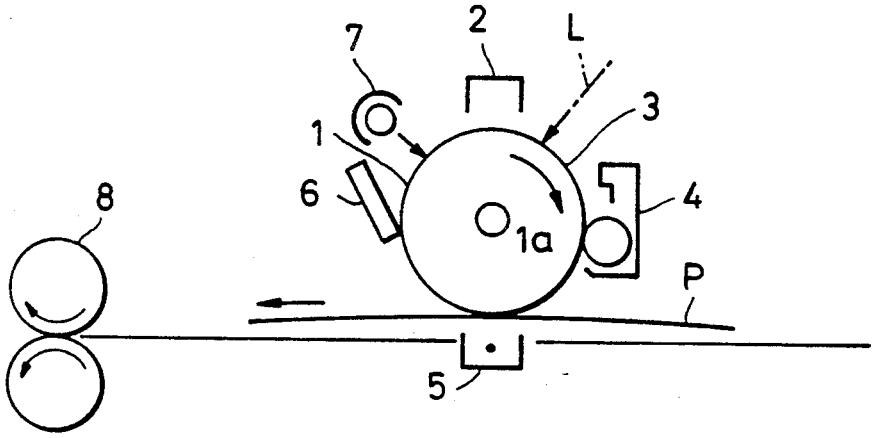
FIG. 1 is a schematic illustration of an electrophotographic apparatus incorporating an electrophotographic photosensitive member of the present invention.

The electrophotographic photosensitive member in accordance with the present invention has a photosensitive layer comprising a compound represented by the following formula (1):

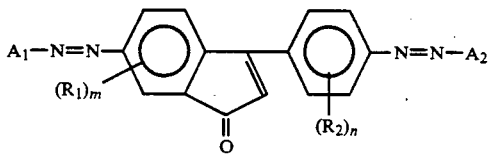

(1)

wherein $R_1$ and $R_2$ are the same or different and are each selected from the group consisting of a hydrogen atom, a halogen atom, substituted or unsubstituted alkyl group, and substituted or unsubstituted aryl group.

More specifically, the alkyl group may be a methyl group, an ethyl group or the like, while a phenyl group or the like is usable as the aryl group Examples of the halogen atoms suitably used are chlorine atom and bromine atom. Examples of the substituted group are alkyl groups such as methyl and ethyl groups or the like and halogen atoms such as chlorine and bromine atoms or the like.

m and n are each 0.1 or 2.

$A_1$ and $A_2$ are the same or different and are each a coupler residue having a phenolic hydroxyl group.

Preferably but not exclusively, $A_1$ and $A_2$ each are selected from the group consisting of the compounds represented by the following formulae (2) to (6):

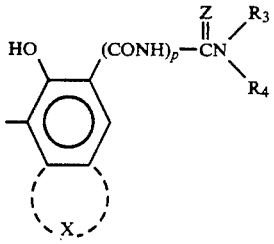

(2)

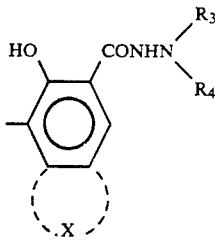

(3)

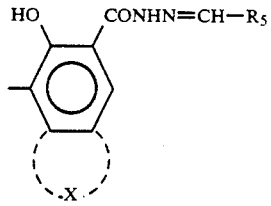

(4)

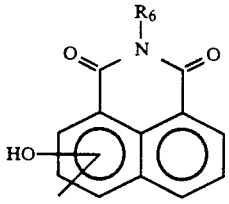

(5)

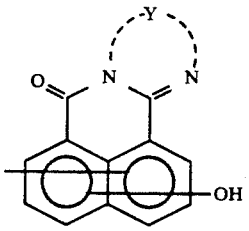

(6)

In formulae (2), (3) and (4), X is a residue forming with the benzene ring in the formulae, a polycyclic aromatic ring or a heterocyclic ring which may have a substituent, such as, for example, a substituted or unsubstituted naphthalene ring, a substituted or unsubstituted anthracene ring, a substituted or unsubstituted carbazole ring, a substituted or unsubstituted benzocarbazole ring and a substituted or unsubstituted dibenzofuran ring.

In formula (6), Y is a substituted or unsubstituted bivalent aromatic hydrocarbon group, or a substituted or unsubstituted bivalent heterocyclic ring which contains nitrogen atom in its ring. Examples of such heterocyclic group are bivalent groups such as o-phenylene, o-naphthylene, perinaphtylene, 1, 2-anthrylene, 3,4-pyrazoldiyl, 2, 3-pyridindiyl, 4,5-pyridindiyl, 6,7-indazoldiyl and 6,7-quinolinediyl.

In formulae (2) and (3), $R_3$ and $R_4$ each are any one of hydrogen atom, a substituted or unsubstituted alkyl group, substituted or unsubstituted aryl group, substituted or unsubstituted aralkyl group and substituted or unsubstituted heterocyclic group. $R_3$ and $R_4$ together are bonded together to form a cyclic amino group containing a nitrogen atom in its ring.

In formula (4), $R_5$ is any one of a hydrogen atom, substituted or unsubstituted alkyl group, a substituted or unsubstituted aryl group, a substituted or unsubstituted aralkyl group and a substituted or unsubstituted heterocyclic group.

In formula (5), $R_6$ is a hydrogen atom, substituted or unsubstituted alkyl group, a substituted or unsubstituted ally group, a substituted or unsubstituted aralkly group and a substituted or unsubstituted heterocyclic group.

Examples of the above-mentioned alkyl group are a methyl group, ethyl group and a propyl group or the like. Examples of the above-mentioned aryl group are a phenyl group, a naphtyl group and an anthryl group or the like. Examples of the above-mentioned aralkyl group are a benzyl group and a phenethyl group or the like. Examples of the above-mentioned heterocyclic group are a pyridyl group, a thienyl group, a carbazolyl group, benzoimidazolyl group and a benzothiazolyl group or the like. Examples of the cyclic amino group having a nitrogen atom in the ring are a pyrrole group, a pyrroline group, a pyrrolidine group, a pyrrolidone group, an indole group, an indoline group, a carbazole group, an imidazole group, a pyrazole group, a pyrazoline group, an oxadine group, an oxazine group and a phenoxazine group or the like.

Examples of the substituent are a halogen atom such as a fluorine atom, chlorine atom, iodine atom and a bromine atom; alkyl groups such as a methyl group, an ethyl group and a propyl group; alkoxy groups such as a methoxy group and an ethoxy group; alkylamino groups such as a dimethylamino group and a diethylamino group; a carbamoyl group; a nitro group; a cyano group; and halomethyl groups such as a trifluoromethyl group.

In formula (2), Z is an oxygen atom or a sulfur atom and p is 0 or 1.

When $A_1$ and $A_2$ in the compound represented by formula (1) each are the substances represented by formulae (2), (3) and (4) and X is a residue forming a benzocarbazole ring with benzene ring, the compound forms a pigment having an absorption region spread wider to near-infrared region. An electrophotographic photosensitive member using this pigment, therefore, can suitably be used in an electrophotographic apparatus which has a semiconductor laser as an exposure light source.

The electrophotographic apparatus of the present invention has the electrophotographic photosensitive member of the invention stated hereinbefore.

The facsimile machine of the present invention has the above-mentioned electrophotographic apparatus having reception means for receiving image information sent from a remote terminal.

Preferred compounds used in the present invention, represented by the formula (1), are shown below only by way of example.

Pigment Example (1)

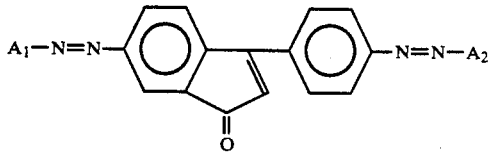

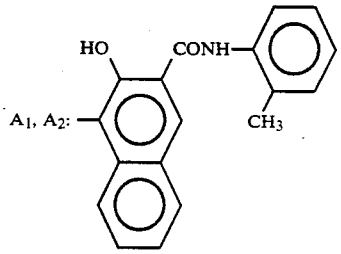

Pigment Example (2)

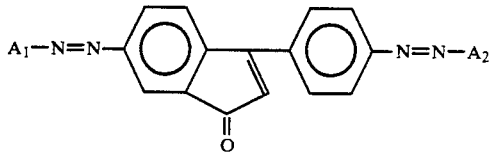

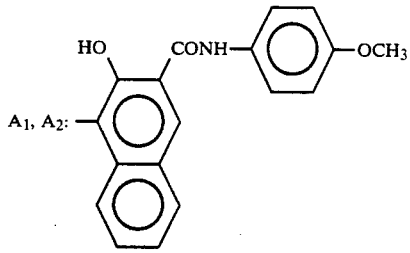

Pigment Example (3)

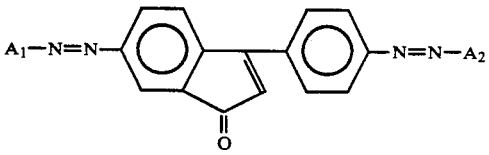

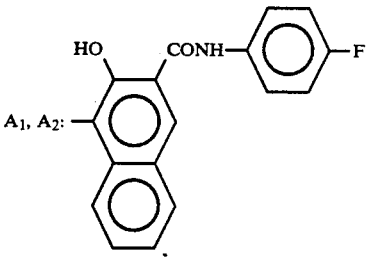

Pigment Example (4)

-continued

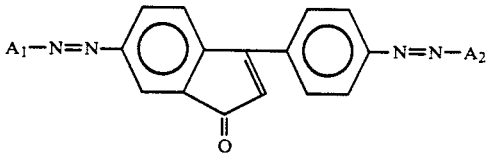

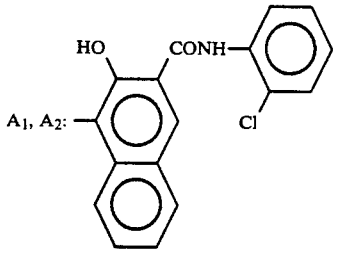

Pigment Example (5)

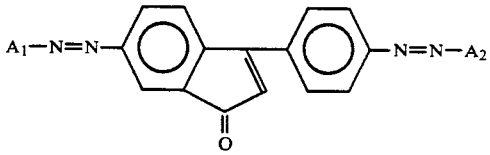

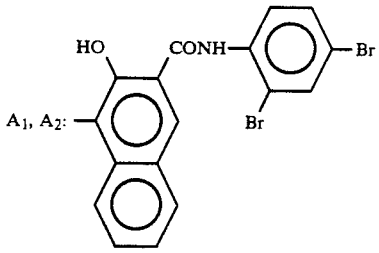

Pigment Example (6)

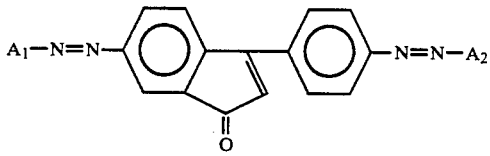

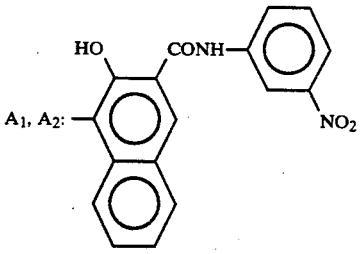

Pigment Example (7)

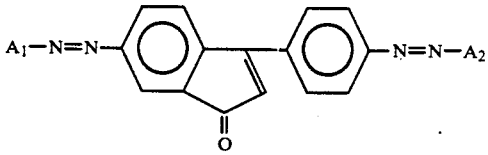

-continued
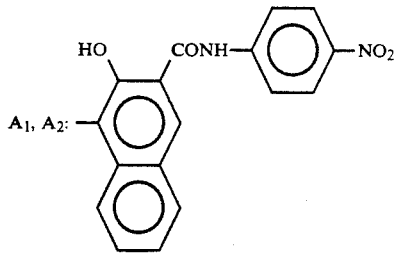
Pigment Example (8)
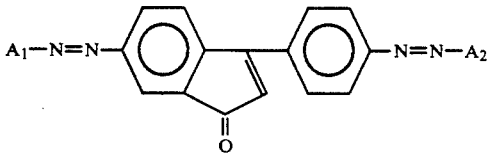
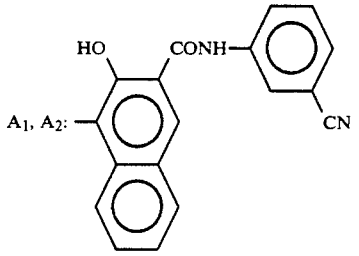
Pigment Example (9)
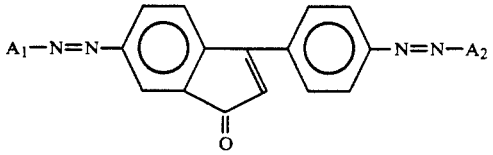
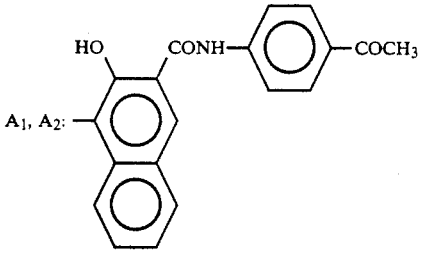
Pigment Example (10)
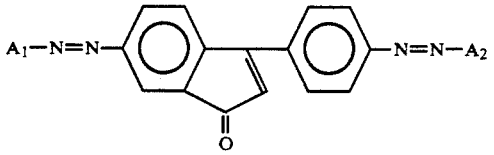
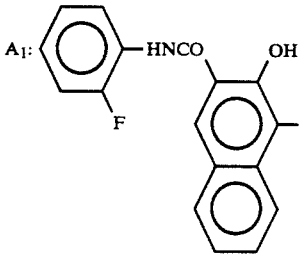
-continued
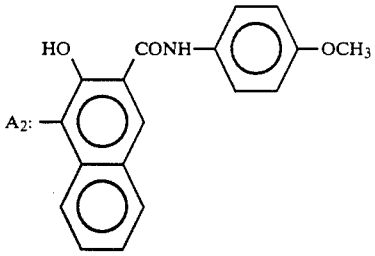
Pigment Example (11)
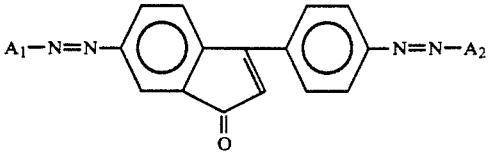
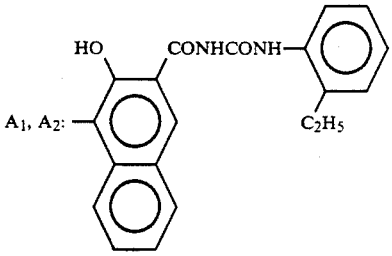
Pigment Example (12)
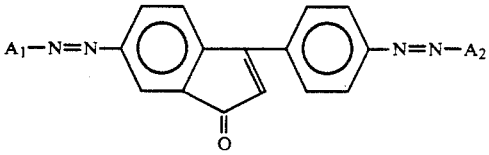
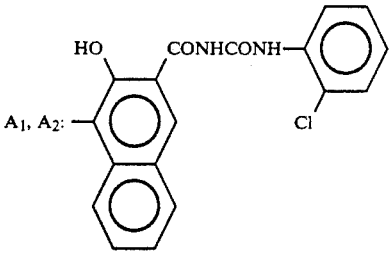
Pigment Example (13)
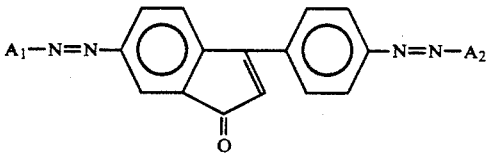
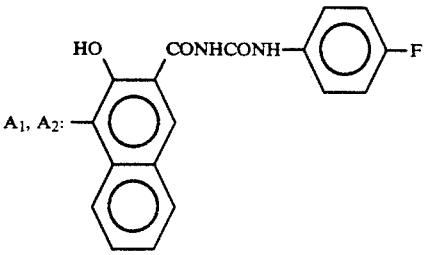

-continued
Pigment Example (14)
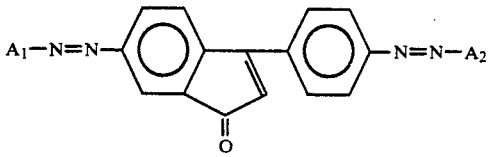
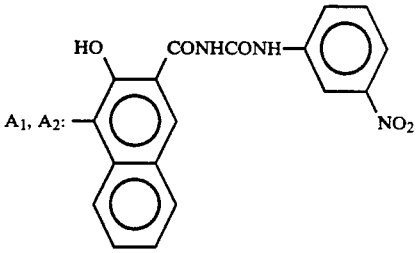
Pigment Example (15)
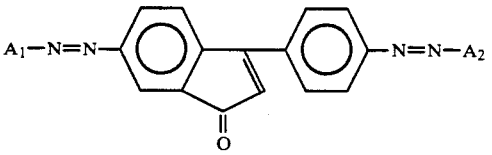
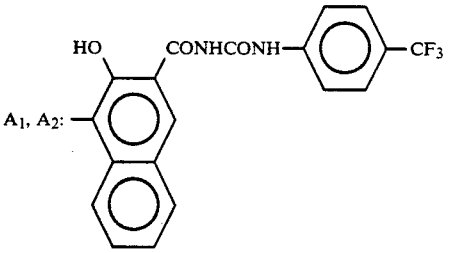
Pigment Example (16)
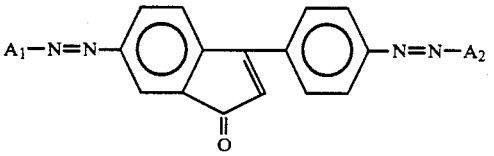
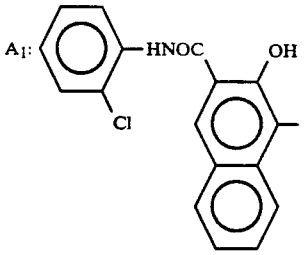
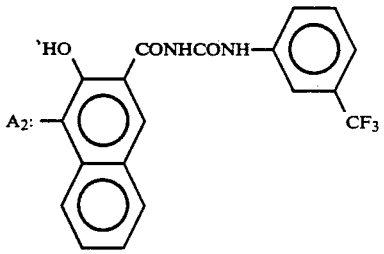
-continued
Pigment Example (17)
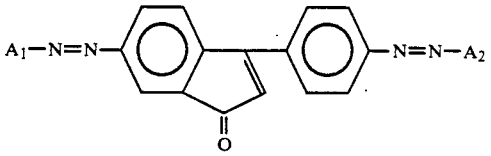
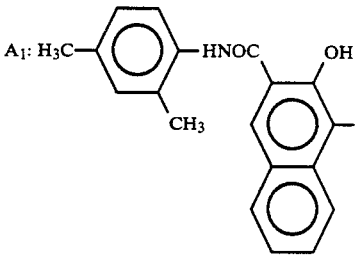
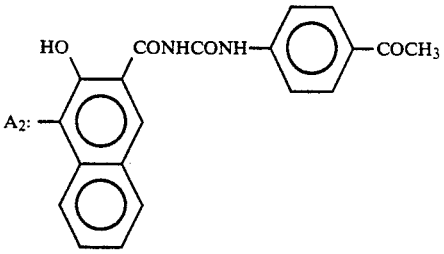
Pigment Example (18)
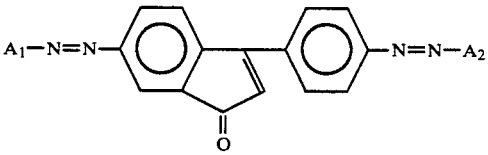
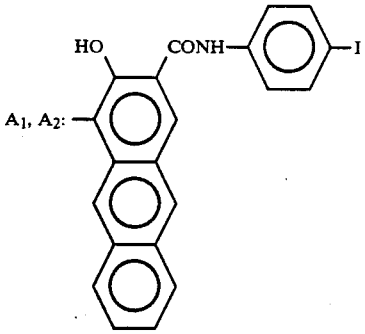
Pigment Example (19)
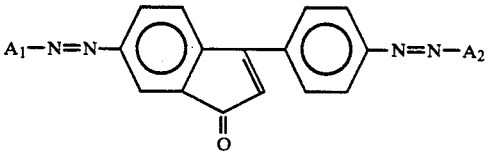

-continued
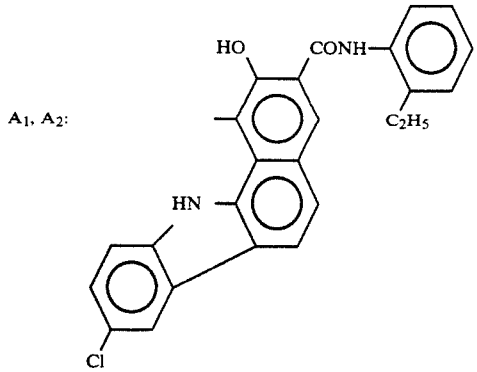
Pigment Example (20)
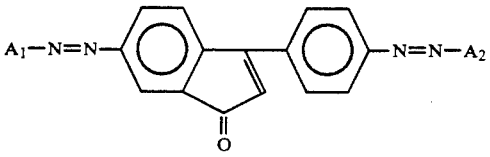
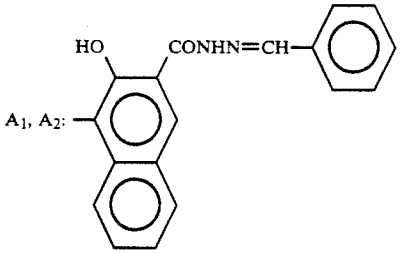
Pigment Example (21)
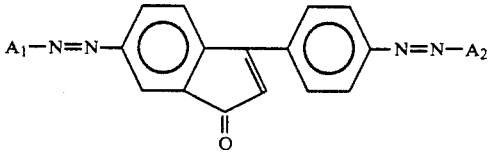
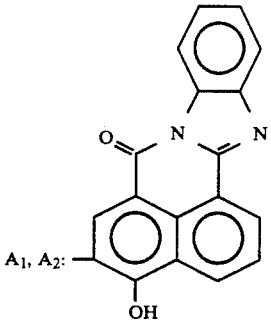
Pigment Example (22)
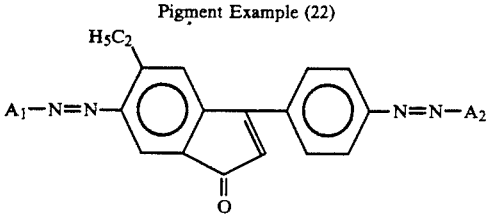
-continued
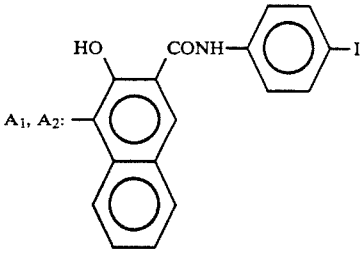
Pigment Example (23)
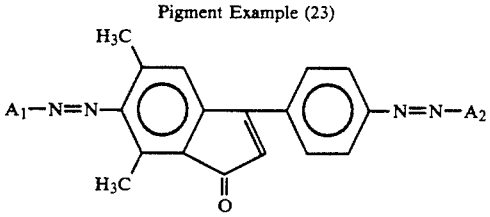
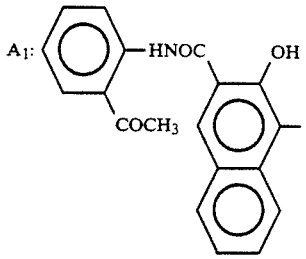
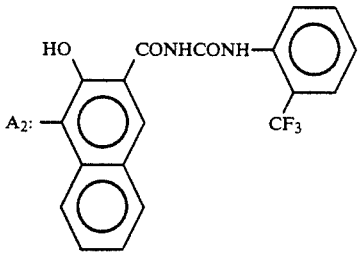
Pigment Example (24)
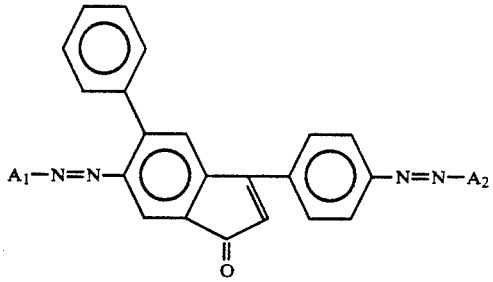
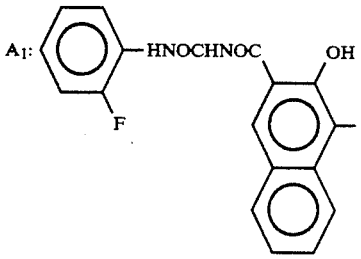

-continued

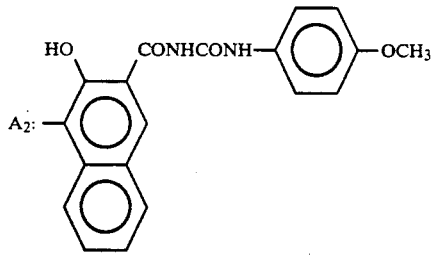

Pigment Example (25)

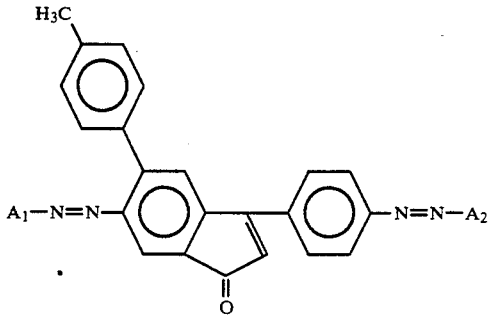

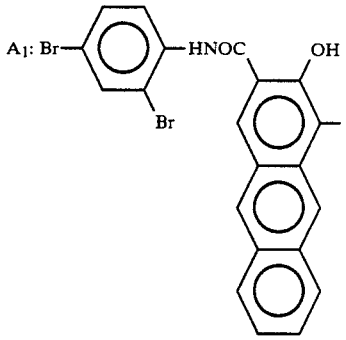

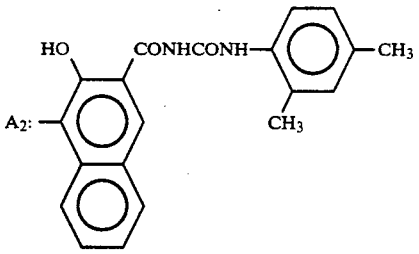

Pigment Example (26)

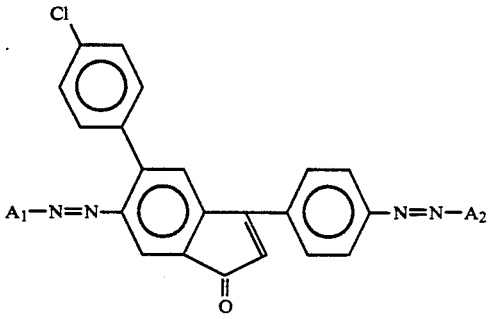

-continued

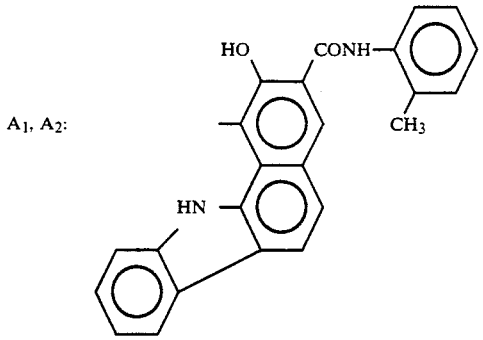

Pigment Example (27)

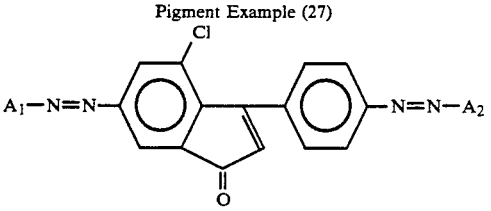

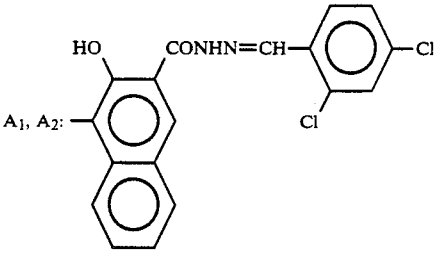

Pigment Example (28)

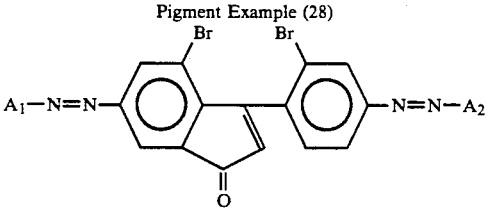

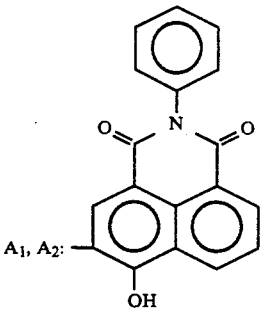

A description will now be given of a general process of synthesizing the compound of the formula (1). It is to be understood, however, the process which will be described is only illustrative and the compound of the formula (1) can also be synthesized by other processes.

When $A_1$ and $A_2$ in the formula (1) are the same matter, a diamine represented by the following formula is converted into a tetrazonium salt by an ordinary method employing sodium nitrite or nitrosylsulfuric acid.

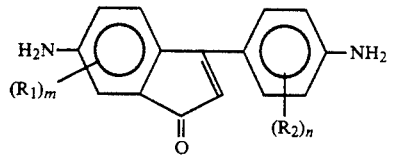

($R_1$, $R_2$, m and n being the same as those in formula (1))

The compound of the formula (1) is then synthesized either by:

a) coupling the tetrazonium salt to the couplers expressed by $A_1$ in an aqueous solution in the presence of an alkali; or (b) converting the tetrazonium salt into a stable salt such as a borofluoric salt or zinc chloride double salt, and coupling the salt to the couplers in an organic solvent such as N,N-dimethylformamide (DMF) or dimethyl sulfoxide in the presence of a base such as sodium acetate, triethylamine or N-methylmorpholine.

When $A_1$ and $A_2$ in the formula (1) are different, the compound can be formed either by:

(a) causing 1 mole of one of the two couplers to couple with 1 mole of the above-mentioned tetrazonium salt, followed by coupling of 1 mole of the other coupler; or (b) effecting coupling with the two types of couplers mixed with each other.

In order to attain a higher efficiency of the synthesis, however, it is preferred to synthesize the compound of the formula (1) by:

(c) protecting one of the amino groups of the diamine of the formula shown above by, for example, an acetyl group, forming the diamine compound after the protection of one of the azo groups, into a diazo compound, coupling one of the couplers, removing the protective group by hydrolysis with, for example, hydrochloric acid, forming the product again into a diazo compound, and coupling the other of the couplers.

Practical examples of the synthesis of the compound used in the present invention are shown below.

SYNTHESIS EXAMPLE (SYNTHESIS OF PIGMENT EXAMPLE (1))

A 300 ml beaker was charged with 150 ml of water, 20 ml (0.23 mole) of thick hydrochloric acid, and 7.6 g (0.032 mole) of a compound represented by the following formula:

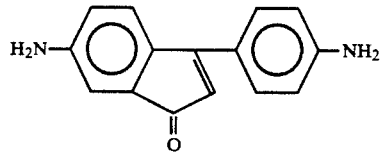

The mixture was then cooled to 0° C. Meanwhile, an aqueous solution was prepared by dissolving 4.6 g (0.067 mole) of sodium nitrite in 10 ml of water. The aqueous solution, maintained at 5° C. or below, was dripped into the above-mentioned mixture in 10 minutes, and the thus obtained solution was agitated for 15 minutes. After a filtration through carbon, an aqueous solution prepared by dissolving 10.5 g (0.096 mole) of sodium borofluoride in 90 ml of water was dripped into the above-mentioned solution while the mixture is agitated, thereby causing precipitation of borofluoride salt.

The thus obtained borofluoric salt was collected through filtration and was rinsed first with chilled water and then with acetonitrile. The rinsed product was then dried under a reduced pressure at the room temperature, whereby a compound represented by the following formula was obtained.

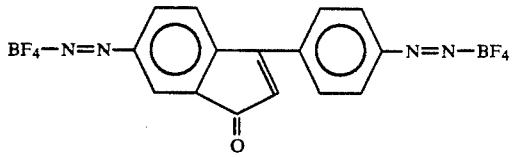

The yield was 9.0 g in quantity and 65% in ratio.

Subsequently, a 1 liter beaker was charged with 500 ml of DMF and 11.6 g (0.042 mole) of the compound expressed by the following formula was dissolved in DMF. After cooling the solution to 5° C., 8.6 g (0.020 mole) of borofluoric salt mentioned above was dissolved in the solution, followed by a 5-minute dripping of 5.1 g (0.050 mole) of triethylamine. After a 2-hour agitation, precipitated pigment was collected through filtration and was rinsed four times with DMF and three times with water. The pigment was then frozen and dried.

The yield was 8.6 g in quantity and 5.3% in ratio.

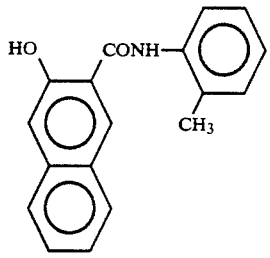

Results of an elementary analysis of the product compound are shown below:

| | Calculated value (%) | Measured value (%) |
|---|---|---|
| C | 75.34 | 73.20 |
| H | 4.47 | 4.32 |
| N | 10.34 | 11.40 |

According to the present invention, the photosensitive layer of the photosensitive member contains a compound expressed by the formula (1). The photosensitive layer can have, for example, one of the following constructions.

(1) a two-layered structure composed of an upper layer containing a charge-generating material (charge-generating layer) and a lower layer containing a charge-transporting layer (charge transporting layer)

(2) a two-layered structure composed of an upper layer which is a charge-transporting layer and a lower layer which is a charge-generating layer (3) a single layer containing both a charge-generating material and a charge-transporting material.

Among these three types of structures, the two-layered structure (1) is used most suitably.

A detailed description will now be given of the construction of the photosensitive layer, in particular the photosensitive layer of the type (1) mentioned above.

The charge-generating layer can be formed by preparing a coating solution by dissolving an azo pigment of the formula (1) in a suitable solvent together with a binder resin, and applying the solution to a conductive substrate. The thickness of the charge-generating layer is preferably 5 μm or less, more preferably from 0.1 to 1.0 μm.

The binder resin has a wide selection among various types of insulating resins and organic photoconductive polymers For instance, it is possible to use, as the binder resin, polyvinylbutyral, polyvinylbenzal, polyallylate, polycarbonate, polyester, phenoxy resin, cellulose resin, acrylic resin or polyurethane. The content of the binder resin in the charge-generating layer is preferably 80 wt% or less, more preferably 40 wt% or less.

Any suitable solvent capable of dissolving the above-mentioned binder resin can be used. Practical examples of such solvent are: ethers such as tetrahydrofuran and 1, 4-dioxane; ketones such as cyclohexanone and methylethylketone; amides such as N, N-dimethyl formamide; esters such as methyl acetate and ethyl acetate; aromatic compounds such as toluene, xylene and chlorobenzene; alcohols such as methanol, ethanol and 2-propanol and aliphatic hydrocarbon halides such as chloroform, methylene chloride, dichloroethylene, carbon tetrachloride and trichloroethylene. Preferably, the solvent does not dissolve later-mentioned materials of the charge-transporting layer and the under-coat layer.

The azo pigment used in the present invention may be either crystalline or amorphous. It is also possible to use two or more types of azo pigments expressed by the formula (1) or to combine the azo pigment or azo pigments with one or more known charge-generating materials, and such modifications also fall within the scope of the invention.

The charge-transporting layer is formed on the upper or lower side of the charge-generating layer and has a function to receive charge carriers from the charge-generating layer and to transport them under the influence of an electric field.

The charge-generating layer can be formed by preparing a solution by dissolving a charge-transporting material in a solvent together with a binder resin which is added as required, and applying the solution. The thickness of the charge-transporting layer preferably ranges from 5 to 40 μm, more preferably from 15 to 30 μm.

Two types of charge-transporting materials are available: namely, electron-transporting material and hole transporting material.

Examples of the charge-transporting material are electron-attracting substances such as 2,4,7-trinitrofluorenone, 2,4,5,7-tetranitrofluorenone, chloranil and tetracyanoxydimethane, and polymers of such substances.

Examples of the hole transporting material are: polycyclic aromatic compounds such as pyrene and anthracene; heterocyclic compounds of carbazole type, indole type, oxadiazole type, imidazole type, oxazole type, thiazole type, oxadiazole type, pyrazole type, pyrazoline type, thiazole type and triazole type; hydrozone-type compounds such as p-diethylaminobenzoaldehyde-N,N-diphenylhydrazone and N,N-diphenylhydradino-3-methylidene-9-ethylcaerbazole; styryl type compounds such as α-phenyl-4'-N,N-diphenylaminostilbene and 5-[4-(di-p-tolylamino)benzylidene]-5H-dibenzo[a,d-]cycloheptene; benzidine type compounds; triarylmethane type compounds; triphenylamine type compounds; and polymers which have, in their main or side chains, groups derived from these compounds, such as, for example, poly-N-vinylcarbazole and polyvinyl anthracene.

It is also possible to use, as the hole-transporting substance, an inorganic material such as selenium, selenium-tellurium, amorphous silicon or cadmium sulfide.

Only one of such charge-transporting material may be used alone or two or more of them may be used in combination.

When the charge-transporting material itself does not have any film-forming nature, the charge-transporting layer can be formed with the aid of a binder. More specifically, it is possible to use an insulating resin such as an acrylic resin, polyallylate, polyester, polycarbonate, polystyrene, acrylonitrile-styrene copolymer, polyacrylamide, polyamide or chlorinated rubber, as well as an organic photoconductive polymer such as poly-N-vinylcarbazole and polyvinyl anthracene.

Another practical form of the electrophotographic photosensitive member of the present invention has a single-layered photosensitive layer containing both an azo pigment of the formula (1) and a charge-transporting material. In such a form, it is possible to use a charge-transporting complex formed of, for example, a combination of poly-N-vinylcarbazole and trinitrofluorenone, as the charge-transporting material, in place of the charge-transporting materials mentioned above.

The single-layered photosensitive layer preferably has a thickness ranging from 5 to 40 μm, preferably 10 to 30 μm. The electrophotographic photosensitive member of the present invention can have a protective resin layer formed on the photosensitive layer to protect the latter against any undesirable external mechanical and chemical effects. It is also possible to incorporate a resin layer which contains conductive particles or charge-transporting material.

The electrophotographic photosensitive member of the present invention also may have an under-coat layer which is formed between the conductive substrate and the photosensitive layer and which has a barrier function and a bonding function.

The under-coat layer can be formed from, for example, casein, polyvinylalcohol, nitrocellulose, polyamide (nylon 6, nylon 66, nylon 610, copolymeric nylon and alkoxymethylated nylon), polyurethane or aluminum oxide.

Preferably, the thickness of the under-coat layer is 5 μm or less, more preferably from 0.1 to 3 μm.

Each of the protective layer, resin layer and under-coat layer can be formed by preparing a solution using a suitable organic solvent and applying the solution by, for example, dip-coating method, spray coating method, beam-coating method, roller-coating method, Meyer bar coating method, blade-coating method or the like.

The conductive substrate can be formed from a suitable material such as, for example, aluminum, aluminum alloy, copper, zinc, stainless steel, vanadium, molybdenum, chromium, titanium, nickel, indium, gold or platinum. The substrate also maybe formed from a sheet of plastic, e.g., polyethylene, polypropylene, polyvinyl chloride, polyethylene terephthalate and acrylic resin, clad with a film of one of the above-mentioned metals or alloys formed by vacuum evaporation. It is also possible to use a conductive substrate which is formed by applying conductive particles, e.g., carbon black, silver particles or the like, together with a suitable binder, to the surface of a plastic, metal or alloy sheet of the type mentioned above. It is even possible to use a substrate which is formed by impregnating a plastic or paper sheet with conductive particles.

The substrate can have various forms such as drum-like form, sheet and belt-form. The form of the substrate is determined in accordance with the type of the electrophotographic apparatus in which the electrophotographic photosensitive member is used.

The electrophotographic photosensitive member of the present invention can be used not only in electrophotographic copying machines but also in in various types of other electrophotographic equipment including facsimile machines, laser-beam printers, CRT printers, LED printers, liquid-crystal printers, laser plate-making systems and so forth.

FIG. 1 schematically shows the structure of a transfer-type electrophotographic apparatus which incorporates an electrophotographic photosensitive member of the present invention.

Referring to FIG. 1, the electrophotographic apparatus has a drum-type photosensitive member 1 serving as an image carrier and adapted to be driven to rotate at a predetermined peripheral speed in the direction of an arrow about the axis 1*a*. The outer peripheral surface of the photosensitive member 1 is uniformly charged to a predetermined positive or negative potential by a charging means 2 as the photosensitive member 1 rotates. The charged surface of the photosensitive member 1 is then brought to an exposure section 3 where the surface is exposed to image light L applied by an exposure means (not shown) such as of slit-exposure type of laser beam scanning type, whereby an electrostatic latent image corresponding to the image light is progressively formed on the peripheral surface of the photosensitive member in accordance with the rotation of the photosensitive member.

The surface of the photosensitive member 1 carrying the electrostatic latent image then passes through a developing section where the latent image is developed by a developing means 4 with a toner, whereby the latent image is changed into a toner image. The toner image is then progressively transferred by a transfer means 5 to the surface of a transfer member P which is fed from a sheet feeder (not shown) into the clearance between the photosensitive member 1 and the transfer means 5 in synchronization with the rotation of the photosensitive member 1.

The transfer member P, which now carries the image transferred thereto, is then separated from the surface of the photosensitive member and is introduced into an image fixing means 8 in which the image is fixed to the transfer member P, whereby a copy of the original is produced and delivered to the outside of the apparatus.

Meanwhile, the surface of the photosensitive member 1 after the transfer of the image is moved to a cleaning section where a cleaning means 6 removes residual toner particles from the surface of the photosensitive member 1 thereby cleaning the same. The cleaned, surface is then subjected to a charge-removing treatment effected by a pre-exposure means 7 to become ready for the next cycle of the image-forming operation.

A corona charger, which is used commonly in this type of apparatus, may be used as the charging means 2 for uniformly charging the photosensitive member 1 in the described apparatus. The transfer means 5 also may be of corona type which is generally used in this type of apparatus.

In the described electrophotographic apparatus, two or more of major components such as the photosensitive member, developing means, cleaning means and so forth may be constructed together in the form of a unit which is detachably mounted on the body of the apparatus. For instance, at least one of the charging means, developing means and the cleaning means is supported as a unit with the photosensitive member which can be detachably mounted in the apparatus through a suitable guiding means such as guide rails. It is also possible to unite the charging means and/or the developing means with the detachable unit.

When the electrophotographic apparatus is a copying machine or a printer, the exposure to the image light may be conducted by applying the light reflected by or transmitted through the original to the photosensitive member or by irradiating the photosensitive member with a light which is produced or controlled by a laser beam scanner, an LED array or a liquid-crystal shutter array which is driven in accordance with a signal derived from a sensor which reads the image of the original.

When the electrophotographic apparatus is used as the printer of a facsimile machine, the image light L is suitably produced and controlled in accordance with data received from a remote station.

Figure 2:
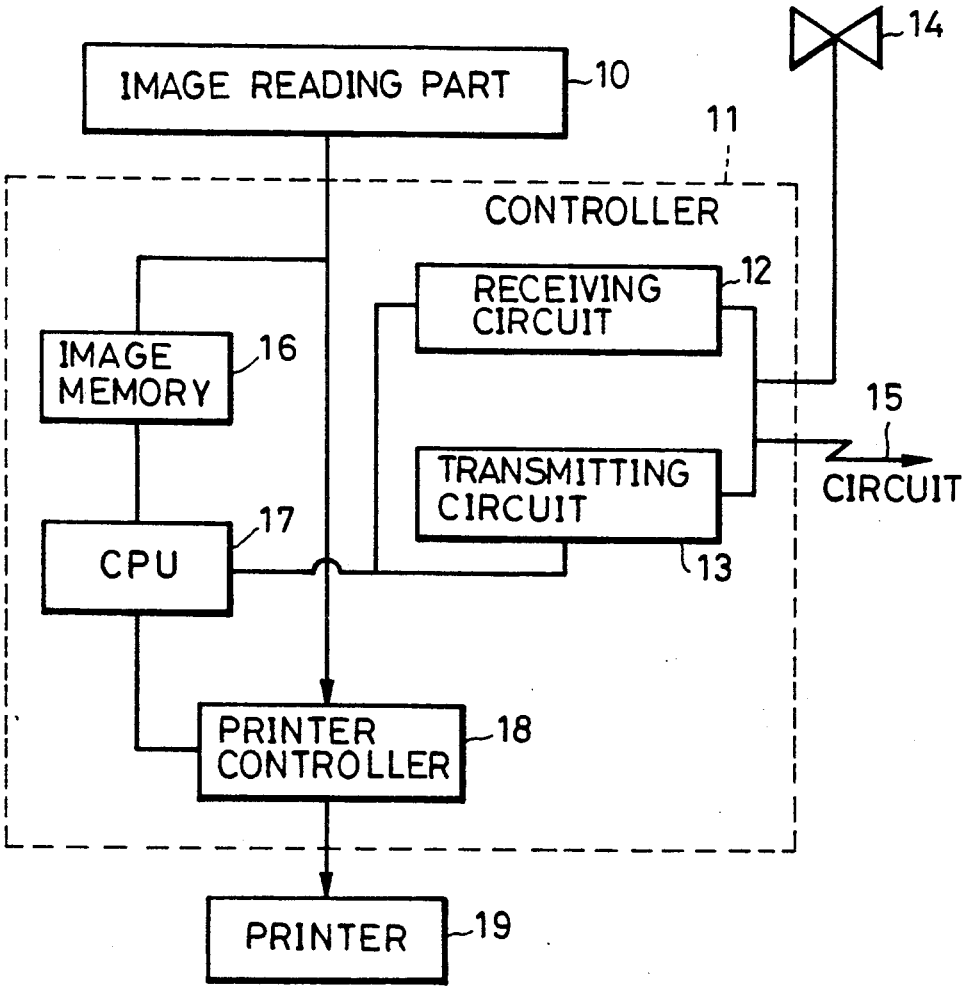
FIG. 2 is a block diagram of a facsimile machine incorporating an electrophotographic photosensitive member of the present invention.

FIG. 2 is a block diagram of an example of such a facsimile machine. The facsimile machine has a controller 11 which controls an image reading section 10 and a printer 19. The controller 11 is under the control of a CPU 17. Data read by the image reading section is transmitted to the opposite station through a transmission circuit 13. The data from the opposite station is input to the printer 19 through a receiving circuit 12. The facsimile machine also has an image memory capable of storing image data. The operation of the printer 19 is controlled by a printer controller 18. Numeral 14 denotes a telephone.

Image information signals received from the remote opposite station via a telephone circuit 15 are demodulated in the receiving circuit 12 and are then assembled by the CPU 17 to form image data which are successively stored in the image memory 16. When the image of at least one page has been stored in the image memory 16, printing is executed to print the stored image. To this end, the CPU reads image data of each page from the memory 16 and delivers the same to the printer controller 18. Upon receipt of the one-page image data from the CPU 17, the printer controller 18 controls the printer 19 to enable it to print the image of the page.

During the printing, the CPU 17 is in receipt of the image data signals of the next page, whereby the successive pieces of image information received from the remote station are recorded.

The invention will be described in more detail through illustration of Examples.

EXAMPLE 1

A solution was prepared by dissolving, in 95 g of methanol, 5 g of methoxymethylated nylon (weight average molecular weight 32,000) and 10 g of alcohol-soluble copolymeric nylon (weight average molecular weight 29,000). The solution was applied to the surface of a substrate made of aluminum by means of a Meyer bar, whereby an under-coat layer was formed on the substrate. This under-coat layer had a thickness of 1 μm after drying.

Then, 1 g of Pigment Example (1) was added to a solution which was formed by dissolving 2 g of butyral resin (butyralation degree 63 mol%) in 95 g of cyclohexanone, and the mixture thus formed was dispersed for 20 hours by means of a sand mill. The thus-obtained dispersion liquid was applied to the surface of the above-mentioned under-coat layer by means of a Meyer bar and was dried to form a charge-transporting layer of 0.2 μm thick.

Subsequently, 5 g of a hydrazone compound expressed by the following formula was dissolved in 40 g of chlorobenzene together with 5 g of polymethylmethacrylate (weight average molecular weight 100,000).

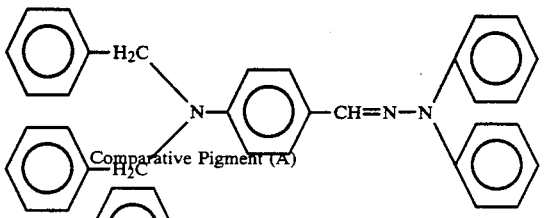

Comparative Pigment (A)

The thus-obtained solution was then applied by a Meyer bar to the surface of the charge-generating layer and was dried to become a charge-transporting layer of 22 μm thick, whereby an electrophotographic photosensitive member was completed.

The electrophotographic photosensitive member was then negatively charged by a corona discharge of −5KV, using an electrostatic copy paper testing apparatus Model SP-428 produced by Kawaguchi Denki Kabushiki Kaisha. The electrophotographic photosensitive member was then held for 1 second in darkness and was exposed to a light from a halogen lamp at an illuminance of 10 lux. The charging characteristics of the electrophotographic photosensitive member were then evaluated. For the purpose of the evaluation, the surface potential $V_0$, as well as the photosensitivity in terms of the exposure amount (E1/2) necessary for attenuating the surface potential from the level obtained after the 1-second holding in darkness down to half this level, was measured.

The results are shown in Table 1.

EXAMPLES 2-8

Electrophotographic photosensitive members were produced and evaluated in the same manners as those in Example 1, except that pigments shown in Table 1 were used. The results of evaluation are also shown in Table 1.

Comparative Example 1

TABLE 1

| Example No. | Pigment Example No. | $V_0$ (−V) | $E_{\frac{1}{2}}$ (lux · sec) |
|---|---|---|---|
| 1 | (1) | 700 | 2.4 |
| 2 | (4) | 700 | 1.7 |
| 3 | (7) | 690 | 4.3 |
| 4 | (15) | 685 | 3.1 |
| 5 | (16) | 705 | 1.3 |
| 6 | (22) | 720 | 4.8 |
| 7 | (25) | 710 | 2.5 |
| 8 | (28) | 710 | 4.9 |

An electrophotographic photosensitive member was produced and evaluated in the same manners as those in Example 1 except that the following Comparative Pigment (A), disclosed in Japanese Patent Unexamined Publication No. 1-312550, was used in placed of Pigment Example 1. The surface potential $V_0$ was −710 (V) and the sensitivity E1/2 was 7.3 (lux.sec).

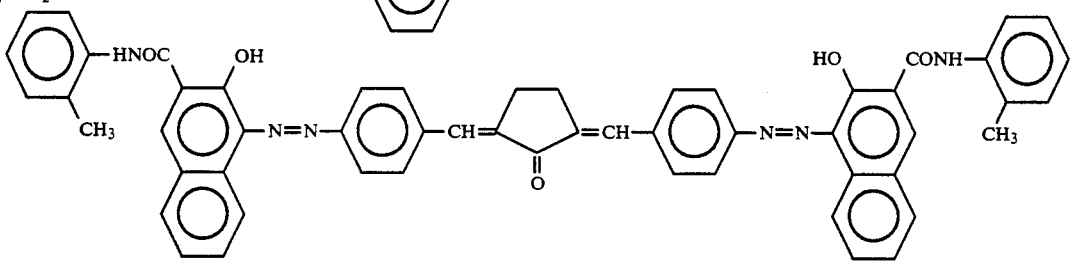

EXAMPLES 9-12

Electrophotographic photosensitive members produced by the same processes as Examples 1, 2, 4 and 5 were adhered to cylinders which were to be mounted on an electrophotographic copying machine having a corona charger capable of charging the photosensitive member to −6.5 KV, an exposure optical system, a developing unit, a transfer charger, a charge-removing optical system and a cleaner.

Test copying operations were conducted using these photosensitive members. More specifically, 5,000 copying cycles were executed for each photosensitive member, setting the initial dark potential $V_D$ and the initial light potential $V_L$ at about −700 V and about −200 V, respectively, and the amounts of variations $\Delta V_D$ and $\Delta V_L$ of the dark and light potentials were measured for each electrophotographic photosensitive member, for the purpose of evaluation of durability of the photosensitive member. The results are shown in Table 2. It is to be noted that, in Table 2, a negative or minus sign of the amount of potential variation means that the absolute value of the potential was reduced, while a positive or plus sign shows that the absolute value of the potential was increased.

Comparative Example 2

The electrophotographic photosensitive member of Comparative Example 1 was subjected to the same test as that conducted in Example 9 to examine variation of potentials after repeated use, for the purpose of evaluating the durability of those electrophotographic photosensitive member. The variations $\Delta V_D$ and $\Delta V_L$ of the dark and light potentials were −65 (V) and +40 (V), respectively.

TABLE 2

| Example | $\Delta V_D$(V) | $\Delta V_L$(V) |
|---|---|---|
| 9 | −20 | +20 |
| 10 | −10 | 0 |
| 11 | +5 | +35 |
| 12 | −5 | +20 |

EXAMPLE 13

A polyethylene terephthalate film, having an aluminum layered formed by evaporation, was prepared, and an under-coat layer of polyvinylalcohol (weight average molecular weight 80,000), 0.4 μm thick, was formed on the aluminum surface of this film.

The dispersion liquid of the disazo pigment used in Example 5 was applied to the surface of the under-coat layer and was dried to form a charge-generating layer of 0.2 μm thick.

On the other hand, a solution was prepared by dissolving, in 40 g of tetrahydrofuran, 5 g of styryl compound having the following composition and 5 g of polycarbonate (weight average molecular weight 55,000). The solution was applied to the surface of the above-mentioned charge-generating layer and was dried to become a charge-transporting layer of 19 μm thick.

The thus-obtained electrophotographic photosensitive member was subjected to the same tests as those for Examples 1 and 9, for the purpose of evaluation of the charging characteristics and durability. The results are shown below.

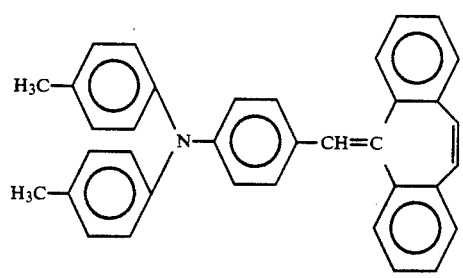

$V_O$: −710 V
E1/2: 1.2 lux.sec
$\Delta V_D$: −10V
$\Delta V_L$: +10V

EXAMPLE 14

An electrophotographic photosensitive member was produced by using the same substrate, charge-generating layer and charge-transporting layer as Example 5, but the sequence of formation of these two layers was reversed. The charging characteristic of this electrophotographic photosensitive member was evaluated in the same method as Example 1. In this case, however, the charging was effected to a positive potential. The results of the evaluation are shown below.

$V_0$: +700 (V)
E1/2: 2.9 lux.sec

EXAMPLE 15

A solution was formed by dissolving, in 50 g of tetrahydrofuran, 5 g of 2,4,7-trinitro-9-fluorenone and 5 g of poly-4,4'-dioxydiphenyl-2,2-propane carbonate (weight average molecular weight 60,000). The solution was applied to the charge-generating layer formed in Example 3 by means of a Meyer bar. The solution was then dried to become a charge-transporting layer of 20 μm thick.

EXAMPLE 16

0.5 g of Pigment Example (14) was shaken together with 9.5 g of cyclohexanone for 5 hours by means of a paint shaker so as to be dispersed in cyclohexanone. On the other hand, a solution was prepared by dissolving, in 40 g of tetrahydrofuran, 5 g of charge-transporting material which was the same as that used in Example 1 and 5 g of polycarbonate. The solution was added to the above-mentioned dispersion liquid and the mixture was shaken for 1 hour, whereby a coating solution was obtained. The coating solution was applied to an aluminum substrate by means of a Meyer bar and was dried to become a photosensitive layer of 20 μm thick, this completing an electrophotographic photosensitive member. The product thus obtained was then subjected to a test which was conducted in the same manner as that in Example 1, for the purpose of evaluating the charging characteristics. In this case, the charging was effected to charge the electrophotographic photosensitive member to a positive potential. The results are shown below:

$V_0$: +700 V
E1/2: 2.6 lux sec

As is understood from the above-described Examples, according to the present invention, there is realized an electrophotographic photosensitive member, apparatus and facsimile machine having superior sensitivity and stably exhibiting superior electrical potential characteristics even after repeated use.

While the present invention has been described with respect to what is presently considered to the preferred embodiments, it is to be understood that the invention is not limited to the disclosed embodiments. The present invention is intended to cover various modifications and equivalent arrangements included with the spirit and scope of the appended claims.

What is claimed is:

1. An electrophotographic photosensitive member comprising a conductive substrate and a photosensitive layer thereon, said photosensitive layer containing a compound represented by the following formula (1):

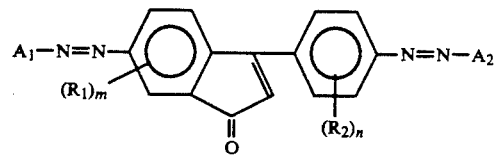

(1)

wherein $R_1$ and $R_2$ are the same or different and are selected from the group consisting of a hydrogen atom, a halogen atom, substituted or unsubstituted alkyl group, and substituted or unsubstituted aryl group, m and n respectively are each 0, 1 or 2, and $A_1$ and $A_2$ are the same or different and each are a coupler residue having a phenolic hydroxyl group.

2. An electrophotographic photosensitive member according to claim 1, wherein said $A_1$ and $A_2$ are each a residue selected from the group consisting of the groups represented by the following formulae (2) to (6):

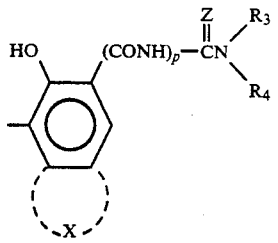

(2)

wherein X is a residue forming a polycyclic aromatic ring or a heterocyclic ring with the benzene ring in the formula; Z is an oxygen atom or a sulfur atom; and $R_3$ and $R_4$ are the same or different and are each selected from the group consisting of; a hydrogen atom, a substituted or unsubstituted alkyl group, a substituted or unsubstituted aryl group, a substituted or unsubstituted aralkyl group, a substituted or unsubstituted heterocyclic group and $R_3$ and $R_4$ together are bonded to form a cyclic amino group with a nitrogen atom in the formula, and p is either 0 or 1;

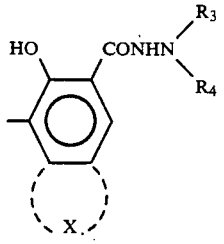

(3)

wherein X, $R_3$ and $R_4$ are the same as in formula (2);

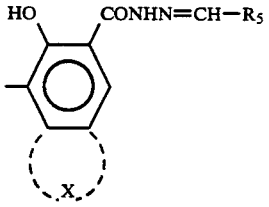

(4)

wherein X is the same as above, and $R_5$ is selected from the group consisting of a hydrogen atom, a substituted or unsubstituted alkyl group, a substituted or unsubstituted aryl group, a substituted or unsubstituted aralkyl group or a substituted or unsubstituted heterocyclic group;

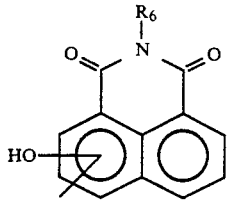

(5)

wherein $R_6$ is the same as $R_5$, and

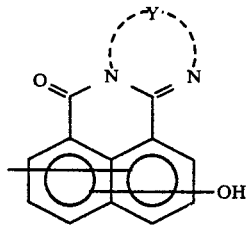

(6)

wherein Y is a substituted or unsubstituted bivalent aromatic hydrocarbon group or substituted or unsubstituted bivalent heterocyclic group having a nitrogen atom in its ring.

3. An electrophotographic photosensitive member according to claim 2, wherein said $A_1$ and $A_2$ each are selected from the formulae (2), (3) and (4).

4. An electrophotographic photosensitive member according to claim 2, wherein said X is a residue forming a benzocarbazole with the benzene ring in the formula.

5. An electrophotographic photosensitive member according to claim 2, wherein said $A_1$ and $A_2$ each are selected from the formulae (2), (3) and (4), and said X is a residue forming a benzocarbazole with the benzene ring in the formula.

6. An electrophotographic photosensitive member according to claim 1, wherein said photosensitive layer contains the compound of formula (1) as a charge-generating substance.

7. An electrophotographic photosensitive member according to claim 1, wherein said photosensitive layer comprises a charge-generating layer and a charge-transporting layer.

8. An electrophotographic photosensitive member according to claim 7, wherein said charge-generating layer is disposed on said conductive substrate and said charge-transporting layer is disposed on said charge-generating layer.

9. An electrophotographic photosensitive member according to claim 7, wherein said charge-transporting layer is disposed on said conductive substrate and said charge-generating layer is disposed on said charge-transporting layer.

10. An electrophotographic photosensitive member according to claim 1, wherein said photosensitive layer is a single layer.

11. An electrophotographic photosensitive member according to claim 1, wherein an undercoating layer is disposed between said conductive substrate and said photosensitive layer.

12. An electrophotographic photosensitive member according to claim 1, wherein a protective layer is disposed on said photosensitive layer.

* * * * *

UNITED STATES PATENT AND TRADEMARK OFFICE

CERTIFICATE OF CORRECTION

PATENT NO. : 5,219,688

DATED : June 15, 1993

INVENTOR(S) : YOSHIO KASHIZAKI, ET AL

It is certified that error appears in the above-indentified patent and that said Letters Patent is hereby corrected as shown below:

IN [57] ABSTRACT

Line 8, "0." should read --0,--.

COLUMN 1

Line 20, "Arts" should read --Art--.
Line 27, "osadiazole," should read --oxadiazole,--.

COLUMN 2

Line 33, "of:" should read --of--.
Line 36, "0.1" should read --0, 1-- and
"$A_1$" should read --and $A_1$--.

COLUMN 3

UNITED STATES PATENT AND TRADEMARK OFFICE

CERTIFICATE OF CORRECTION

PATENT NO. : 5,219,688

DATED : June 15, 1993

INVENTOR(S) : YOSHIO KASHIZAKI, ET AL

It is certified that error appears in the above-indentified patent and that said Letters Patent is hereby corrected as shown below:

Line 5, "group" should read --group.--.
Line 10, "0.1" should read --0, 1--.
Line 64, "forming" should read --forming,--.

COLUMN 4

Line 10, "perinaphtylene," should read --perinaphthylene,--.
Line 28, "ally" should read --aryl-- and
"aralkly" should read --aralkyl--.
Line 33, "naphtyl" should read --naphthyl--.

COLUMN 17

Line 24, "propanol" should read --propanol;--.

UNITED STATES PATENT AND TRADEMARK OFFICE

CERTIFICATE OF CORRECTION

PATENT NO. : 5,219,688

DATED : June 15, 1993

INVENTOR(S) : YOSHIO KASHIZAKI, ET AL

It is certified that error appears in the above-indentified patent and that said Letters Patent is hereby corrected as shown below:

COLUMN 19

Line 13, "in in" should read --in--.

COLUMN 21

Line 23, "Comparative Pigment (A)" should read --$H_2C$ $H_2C$ Comparative Pigment (A)--.

COLUMN 24

Line 19, "this" should read --thus--.
Line 41, "with" should read --within--.

COLUMN 25

Line 21, "of;" should read --of--.

Signed and Sealed this

Twelfth Day of April, 1994

Bruce Lehman

BRUCE LEHMAN

*Commissioner of Patents and Trademarks*

*Attest:*

*Attesting Officer*